US008874018B2

(12) United States Patent
Lee et al.

(10) Patent No.: US 8,874,018 B2
(45) Date of Patent: Oct. 28, 2014

(54) FIXING DEVICE HAVING PRESSING UNIT WITH CARBON NANO TUBE HEATING LAYER

(75) Inventors: Dong-woo Lee, Seoul (KR); Soo-hwan Bae, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 63 days.

(21) Appl. No.: 13/614,095

(22) Filed: Sep. 13, 2012

(65) Prior Publication Data

US 2013/0142553 A1 Jun. 6, 2013

(30) Foreign Application Priority Data

Dec. 6, 2011 (KR) ..... 10-2011-0129768

(51) Int. Cl.
*G03G 15/20* (2006.01)

(52) U.S. Cl.
USPC ..... 399/333; 399/328; 399/331

(58) Field of Classification Search
CPC ..... G03G 15/206
USPC ..... 399/328, 331, 333
See application file for complete search history.

(56) References Cited

U.S. PATENT DOCUMENTS

| | | | | |
|---|---|---|---|---|
| 8,465,838 | B2 * | 6/2013 | Wu | 428/421 |
| 8,509,669 | B2 * | 8/2013 | Moorlag et al. | 399/333 |
| 8,512,840 | B2 * | 8/2013 | Wu | 428/36.91 |
| 2006/0127144 | A1 * | 6/2006 | Watanabe | 399/329 |
| 2008/0286018 | A1 * | 11/2008 | Lee | 399/329 |
| 2010/0183348 | A1 * | 7/2010 | Law et al. | 399/333 |
| 2010/0209154 | A1 * | 8/2010 | Kim et al. | 399/333 |
| 2011/0116849 | A1 * | 5/2011 | Qi et al. | 399/333 |
| 2011/0142508 | A1 * | 6/2011 | Qi et al. | 399/333 |
| 2012/0070208 | A1 * | 3/2012 | Qi et al. | 399/333 |
| 2012/0213563 | A1 * | 8/2012 | Qi et al. | 399/333 |

FOREIGN PATENT DOCUMENTS

| | | |
|---|---|---|
| JP | 09-050199 | 2/1997 |
| JP | 2008-233569 | 10/2008 |
| JP | 2011-043621 | 3/2011 |

* cited by examiner

*Primary Examiner* — G. M. Hyder
(74) *Attorney, Agent, or Firm* — Staas & Halsey LLP

(57) ABSTRACT

An image forming apparatus includes a fixing device that includes a heating unit which comprises a first heat source to heat an unfixed image on a print medium, and a pressing unit which forms a fixing nip by contacting the heating unit, where the pressing unit comprises a carbon nanotube heating layer as a second heat source to heat the unfixed image.

9 Claims, 12 Drawing Sheets

FIXING DEVICE HAVING PRESSING UNIT WITH CARBON NANO TUBE HEATING LAYER

CROSS-REFERENCE TO RELATED APPLICATIONS

This application claims the priority benefit of Korean Patent Application No. 10-2011-0129768 under 35 U.S.C. §119 from, filed on Dec. 6, 2011, in the Korean Intellectual Property Office, the disclosure of which is incorporated herein by reference in its entirety.

BACKGROUND

1. Field

The following description relates to a fixing device for use in an image forming apparatus, and more particularly, to a fixing device for use in an image forming apparatus, where the fixing device includes a pressing unit with a carbon nanotube heating layer.

2. Description of the Related Art

Electrophotographic image forming apparatuses such as, printers, copiers, and facsimile machines, for example, are generally equipped with fixing devices to fix an image onto a print medium.

A typical fixing device includes a heating unit (for example, a heating roller) and a pressing unit (for example, a pressing roller) that together form a fixing nip by pressing against each other. The heating unit may include a heat source, such as a heating lamp, a resistive heating member, or a ceramic heater, for example. While a print medium is being passed through the fixing nip, an image on the print medium may be fixed onto the print medium by heat provided by the heating unit and pressure applied by the fixing nip.

Before the print medium arrives in the fixing nip, the fixing nip, which is disposed between the heating unit and the pressing unit, may already be heated to an appropriate target temperature for fixing an image. During the heating of the fixing nip, part of the heat provided by the heat source of the heating unit may also be transmitted to the inside of the pressing unit, which results in heat loss.

Such heat loss may lead to an increase in the power consumption of the fixing device and deterioration of the performance of the fixing device.

SUMMARY

Additional aspects and/or advantages will be set forth in part in the description which follows and, in part, will be apparent from the description, or may be learned by practice of the invention.

Exemplary embodiments address at least the above problems and/or disadvantages and other disadvantages not described above. Also, the exemplary embodiments are not required to overcome the disadvantages described above, and an exemplary embodiment may not overcome any of the problems described above.

The exemplary embodiments provide a fixing device capable of reducing the consumption of power and improving performance by reducing heat loss and an image forming apparatus having the fixing device.

According to an aspect of the exemplary embodiments, a fixing device, which is included in an electrophotographic image forming apparatus, includes a heating unit which comprises a first heat source to heat an unfixed image on a print medium, and a pressing unit which forms a fixing nip by contacting the heating unit, where the pressing unit comprises a carbon nanotube heating layer as a second heat source to heat the unfixed image.

The carbon nanotube heating layer may be formed by mixing an elastic material and carbon nanotubes.

The elastic material may be liquid silicon rubber (LSR).

The carbon nanotube heating layer may be formed by mixing LSR and the carbon nanotubes in a mass ratio of approximately 95:5 to approximately 85:15.

The pressing unit may include a shaft member which is cylindrical, an elastic layer which surrounds the shaft member, a carbon nanotube heating layer which surrounds the elastic layer, and an anti-adhesion layer which surrounds the carbon nanotube heating layer.

The pressing unit may also include an adiabatic layer which is disposed between the elastic layer and the carbon nanotube heating layer, and an electrically insulating layer which is disposed between the carbon nanotube heating layer and the anti-adhesion layer.

The pressing unit may include a sleeve member, an elastic layer which surrounds the sleeve member, a carbon nanotube heating layer which surrounds the elastic layer, and an anti-adhesion layer which surrounds the carbon nanotube heating layer.

The pressing unit may also include an adiabatic layer which is disposed between the elastic layer and the carbon nanotube heating layer, and an electrically insulating layer which is disposed between the carbon nanotube heating layer and the anti-adhesion layer.

The sleeve member may be elastically supported against the pressing unit.

The sleeve member may be formed of polyimide.

The heating unit may include a first heat source and a belt member which accommodates the first heat source therein and is placed in contact with the pressing unit.

The heating unit may also include a pressing frame which is disposed in the belt member and presses the belt member against the pressing unit.

The heating unit may include a first heat source and a pipe member which accommodates the first heat source therein and is placed in contact with the pressing unit.

The heating unit may include a first heating roller which is placed in contact with the pressing unit, a second heating roller which is distant apart from the first heating roller and accommodates the first heat source therein, and a heat transfer belt which surrounds the first heating roller and the second heating roller.

The first heat source may be at least one of a heating lamp, a resistive heating material, and a ceramic heater.

According to another aspect of the exemplary embodiments, an electrophotographic image forming apparatus includes a fixing device to fix an unfixed image, where the fixing device includes a heating unit which comprises a first heat source to heat an unfixed image on a print medium, and a pressing unit which forms a fixing nip by contacting the heating unit, where the pressing unit comprises a carbon nanotube heating layer as a second heat source to heat the unfixed image.

BRIEF DESCRIPTION OF THE DRAWINGS

The above and/or other aspects will be more apparent by describing certain exemplary embodiments with reference to the accompanying drawings, in which:

FIG. 6 is a cross-sectional view illustrating an example of the fixing device illustrated in

FIG. 5;

DETAILED DESCRIPTION

Figure 1:
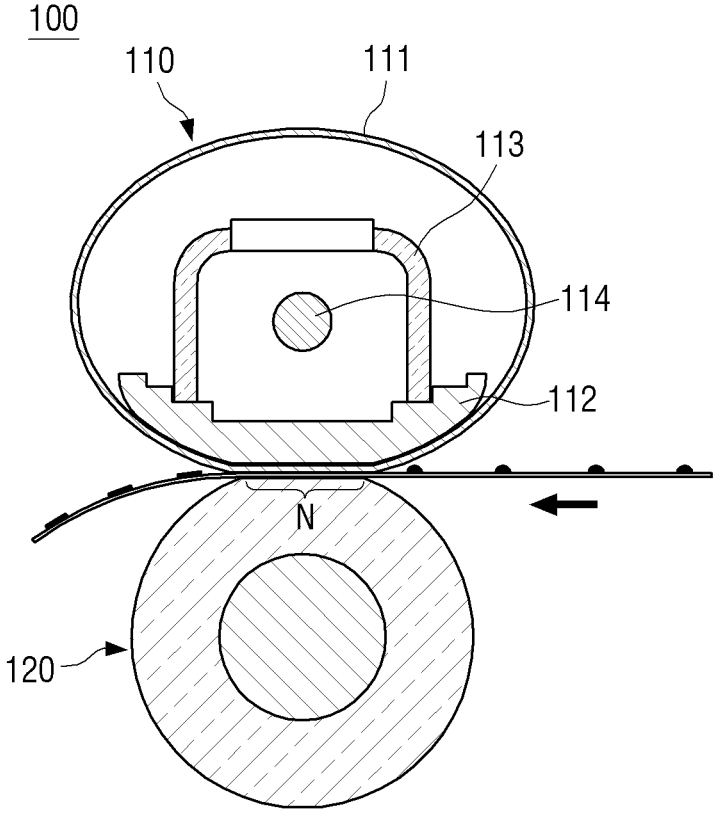
FIG. 1 is a cross-sectional view illustrating a fixing device according to an exemplary embodiment.

Exemplary embodiments are described in greater detail with reference to the accompanying drawings.

In the following description, the same drawing reference numerals are used for the same elements even in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, well-known functions or constructions are not described in detail since they would obscure the exemplary embodiments with unnecessary detail.

Figure 2A:
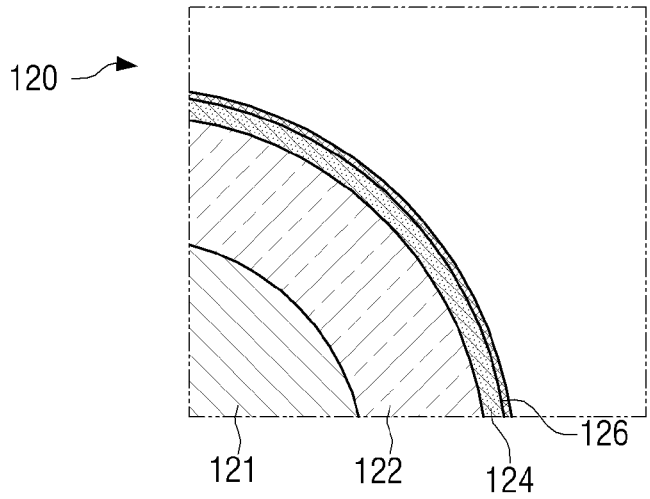
FIG. 2A is an enlarged view illustrating an example of a pressing unit illustrated in FIG. 1.

FIG. 1 is a cross-sectional view illustrating a fixing device according to an exemplary embodiment, and FIG. 2A is an enlarged view illustrating an example of a pressing unit illustrated in FIG. 1.

Referring to FIGS. 1 and 2A, a fixing device 100 includes a heating unit 110 and a pressing unit 120.

The heating unit 110 and the pressing unit 120 may be arranged to face and contact each other, and may form a fixing nip N. The fixing nip N may correspond to the area of contact between the heating unit 110 and the pressing unit 120. While being passed through the fixing nip N, a print medium may be properly heated and pressed by the fixing device 100 so that an image may be fixed onto the print medium.

The heating unit 110 includes a belt member 111, a nip formation member 112, a pressing frame 113, and a first heat source 114.

The belt member 111 may be formed in the shape of a belt, and may be hollow in the middle. The belt member 111 may be disposed to be in contact with the pressing unit 120, and may thus rotate along with the pressing unit 120 during the rotation of the pressing unit 120. The belt member 111 may include a base member (not illustrated) which is pipe-shaped, an elastic layer (not illustrated) which covers the base member, and an anti-adhesion layer (not illustrated) which covers the elastic layer. The base member may be formed of a metallic material with high thermal conductivity such as steel use stainless (SUS), or nickel, for example.

The nip formation member 112 may be disposed between the pressing frame 113 and the belt member 111, and may transfer the pressing force of the pressing frame 113 to the belt member 111. The nip formation member 112 may be disposed to cover at least a part of the belt member 111 which forms the fixing nip N. The nip formation member 112 may have a flat bottom with a predetermined width. The fixing nip N may be formed flat in conformity with the flat bottom of the nip formation member 112. For example, the nip formation member 112 may be formed of a heat-resistant plastic material such as a liquid crystal polymer (LCP).

The pressing frame 113 may be disposed in the belt member 111 to surround the first heat source 114. A plurality of apertures (not illustrated) may be formed along the pressing frame 113 such that heat generated by the first heat source 114 may be transferred to the belt member 111 without being interfered with by the pressing frame 113. The pressing frame 113 may be elastically supported against the pressing unit 120 by an elastic member (not illustrated) such as a coil spring, or a plate spring, for example. The fixing nip N may be formed by the pressing force provided by the elastic member.

The first heat source 114 may be disposed in the middle of the belt member 111. For example, the first heat source 114 may be implemented as a heating lamp or a resistive heating member. The fixing nip N between the pressing unit 110 and the pressing unit 120 may be heated by the heat generated by the first heat source 114, and thus, an unfixed image on the print medium may be heated while passing the print medium through the fixing nip N.

The pressing unit 120 includes a shaft member 121, which is formed in a cylindrical shape, an elastic layer 122, which surrounds the shaft member 121, a carbon nanotube heating layer 124, which is formed on the elastic layer 122, and an anti-adhesion layer 126, which is formed on the carbon nanotube heating layer 124.

The shaft member 121 may be disposed at the center of the pressing unit 120, and may be rotatably supported. The shaft member 121 may be formed of a metallic material or a non-metallic material, and a rigid material. The elastic layer 122 may be formed of an elastic material such as rubber, for example. Due to the elastic layer 122, the pressing unit 120 may be compressed or deformed in the fixing nip N. The anti-adhesion layer 126 may be provided on the outermost side of the pressing unit 120, and may allow the print medium to be easily detached from the pressing unit 120.

The carbon nanotube heating layer 124 may be formed by mixing an elastic material and carbon nanotubes in a predetermined ratio. For example, liquid silicon rubber (LSR) may be used as the elastic material, and the carbon nanotube heating layer 124 may be formed by mixing LSR and carbon nanotubes in a mass ratio of approximately 95:5 to approximately 85:15 so that the carbon nanotube heating layer 124 may have appropriate levels of elasticity and resistivity.

Since the carbon nanotube heating layer 124 contains LSR as its main component, the carbon nanotube heating layer 124 may have elasticity. Accordingly, the carbon nanotube heating layer 124 may be compressively deformed in the fixing nip N along with the elastic layer 122.

Since the carbon nanotube heating layer 124 also contains carbon nanotubes as an auxiliary component, the carbon nanotube heating layer 124 may have the properties of a resistive heating material. Accordingly, in response to the application of a voltage to the carbon nanotube heating layer 124, the carbon nanotube heating layer 124 may generate heat.

Due to the above-mentioned properties of the carbon nanotube heating layer 124, the carbon nanotube heating layer 124 may serve as a second heat source. That is, during the fixing of an image on the print medium, heat may be generated not only by the first heat source 114 of the heating unit 110, but also the second heat source, i.e., the carbon nanotube heating layer 124 of the pressing unit 120, may be transmitted to the fixing nip N between the heating unit 110 and the pressing unit 120.

Because the fixing nip N is heated by both the first heat source 114 and the second heat source 124, the fixing nip N may be heated to a target temperature for fixing an image on the print medium faster than when the fixing device 100 is equipped with the first heat source 114 only. Accordingly, it is possible to reduce not only the warm-up time (WUT) for driving the fixing device 100, but also first page print-out time (FPOT). Therefore, it is possible to improve the performance of the fixing device 100.

Referring to FIG. 2A, the carbon nanotube heating layer 124 may be disposed along the circumference of the pressing unit 120. That is, the carbon nanotube heating layer 124 may be disposed very close to the surface of the pressing unit 120. Thus, it is possible to minimize the amount of heat transmitted from the carbon nanotube heating layer 124 to the shaft member 121 and the elastic layer 122, which are disposed below the carbon nanotube heating layer 124, during the heating of the fixing nip N to the target temperature. In this manner, it is possible to reduce heat loss that may be caused by the transfer of heat to the inside of the pressing unit 120, and thus to increase the efficiency of energy in connection with the heating of the fixing nip N. In addition, it is possible to reduce the consumption of power in connection with the heating of the fixing nip N to the target temperature.

Figure 2B:
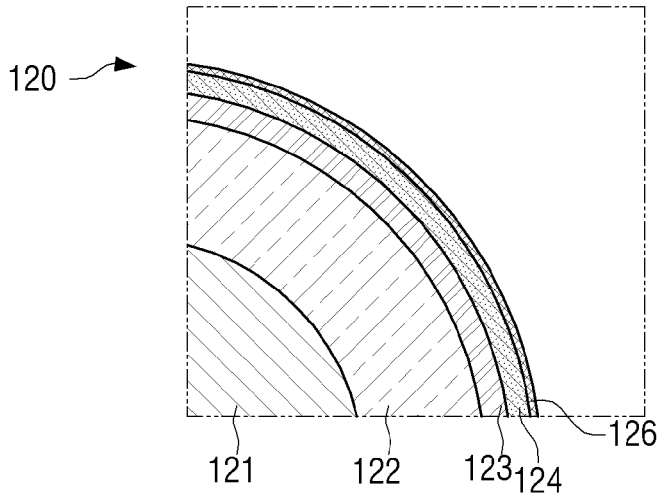
FIGS. 2B, 2C, and 2D are cross-sectional views of variations of the pressing unit illustrated in FIG. 2A.
Figure 2C:
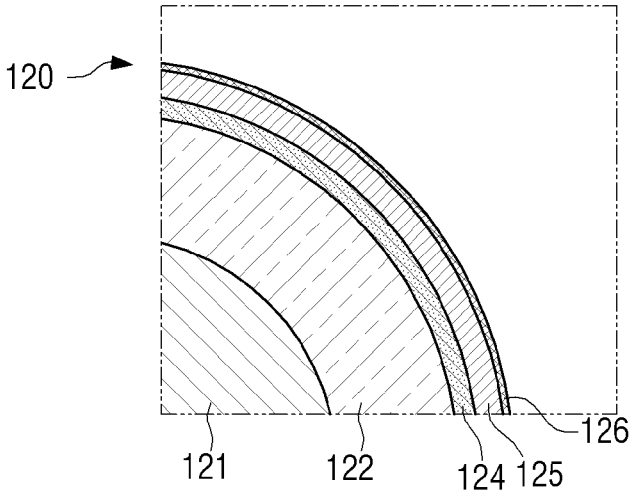
Figure 2D:
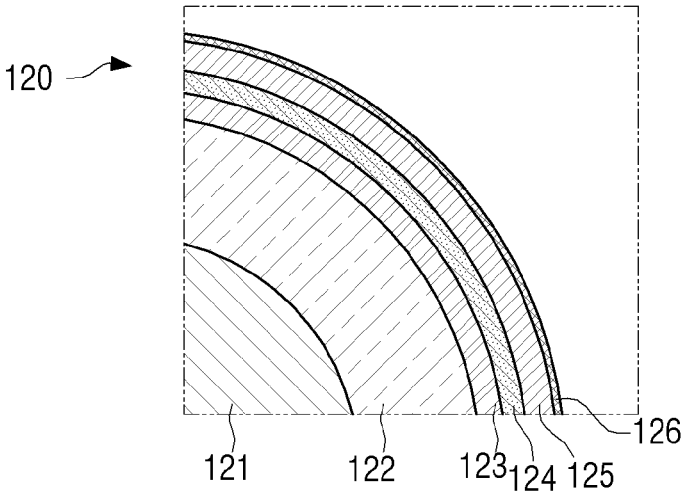

FIGS. 2B, 2C, and 2D are diagrams illustrating variations of the pressing unit 120 illustrated in FIG. 2A, according to exemplary embodiments. Referring to FIG. 2B, the pressing unit 120 may also include an adiabatic layer 123 between the elastic layer 122 and the carbon nanotube heating layer 124. Alternatively, referring to FIG. 2C, the pressing unit 120 may also include an electrically insulating layer 125 between the carbon nanotube heating layer 124 and the anti-adhesion layer 126. Still alternatively, referring to FIG. 2D, the pressing unit 120 may include both the adiabatic layer 123 and the electrically insulating layer 125.

The adiabatic layer 123 may reduce the amount of heat transmitted from the carbon nanotube heating layer 124 to the shaft member 121 and the elastic layer 122. Due to the adiabatic layer 123, heat loss may be further reduced. The electrically insulating layer 125 may protect the rest of the fixing device 100 and a user against a current that flows through the carbon nanotube heating layer 124.

Figure 3:
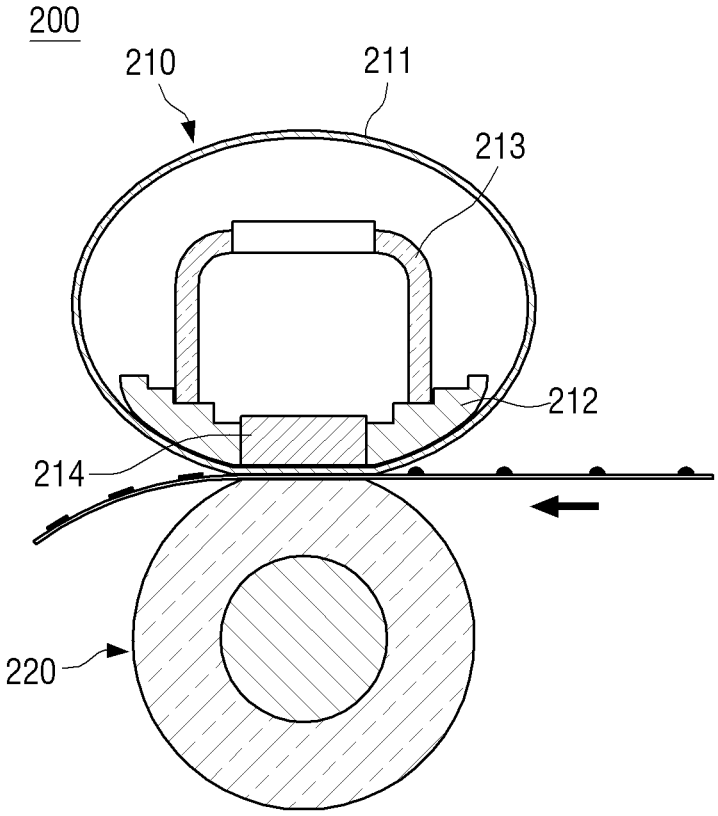
FIGS. 3, 4, and 5 are cross-sectional views illustrating fixing devices according to exemplary embodiments.
Figure 4:
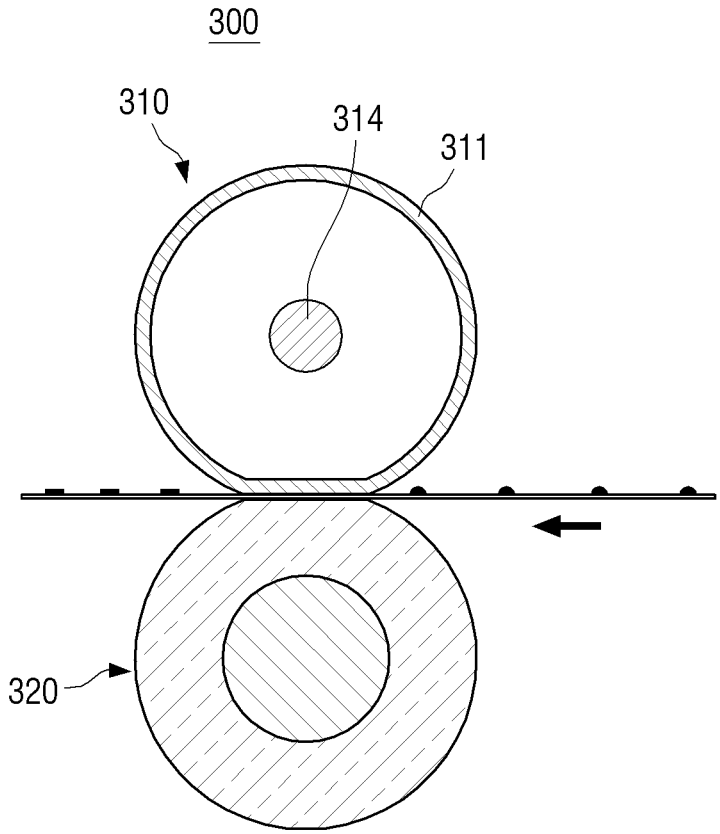
Figure 5:
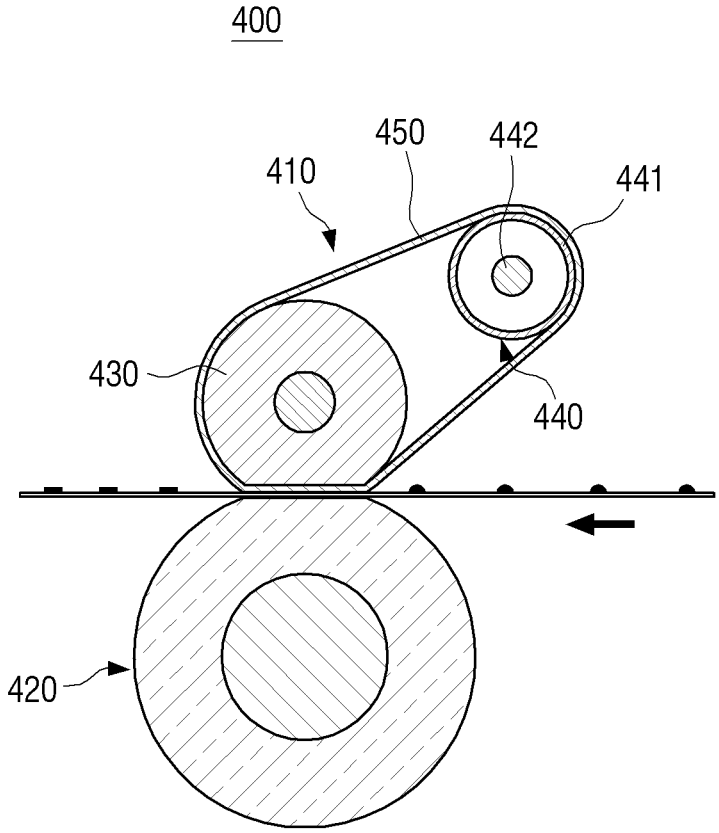

FIGS. 3, 4, and 5 are cross-sectional views illustrating fixing devices according to exemplary embodiments.

Referring to FIG. 3, a fixing unit 200 includes a heating unit 210 and a pressing unit 220.

The pressing unit 220 may be the same as the pressing unit 120 illustrated in FIG. 1. The pressing unit 220, like the pressing unit 120, may include a carbon nanotube heating layer, for example, having the structure illustrated in FIG. 2A, as a second heat source.

The heating unit 210 includes a belt member 211, a nip formation member 212, a pressing frame 213, and a first heat source 214. The belt member 211, the nip formation member 212, and the pressing frame 213 may be the same as their respective counterparts illustrated in FIG. 1. The fixing device 200 may be different from the fixing device illustrated in FIG. 1 in that the first heat source 214 may be implemented as a ceramic heater.

Referring to FIG. 4, a fixing device 300 includes a heating unit 310 and a pressing unit 320.

The pressing unit 320 may be the same as the pressing unit 120 illustrated in FIG. 1. The pressing unit 320, like the pressing unit 120, may include a carbon nanotube heating layer, for example, having the structure illustrated in FIG. 2A, as a second heat source.

The heating unit 310 includes a pipe member 311 and a first heat source 314. The pipe member 311 may be formed of a metal such as aluminum, etc. The pipe member 311 and the pressing unit 320 may contact each other, and may thus form a fixing nip. The first heat source 314 may be disposed in the middle of the pipe member 311. For example, the first heat source 314 may be implemented as a heating lamp or a resistive heating material.

Referring to FIG. 5, a fixing device 400 includes a heating unit 410 and a pressing unit 420.

The pressing unit 420 may be the same as the pressing unit 120 illustrated in FIG. 1. The pressing unit 420, like the pressing unit 120, may include a carbon nanotube heating layer, for example, having the structure illustrated in FIG. 2A, as a second heat source.

The heating unit 410 includes a first heating roller 430 which is disposed opposite to the pressing unit 420 and forms a fixing nip along with the pressing unit 420, a second heating roller 440 which is disposed apart from the first heating roller 430, and a heat transfer belt 450 which is rotatably wound on the first heating roller 430 and the second heating roller 440. The second heating roller 440 includes a pipe member 441, which is cylindrical, and a first heat source 442, which is contained in the pipe member 441. The pipe member 441 may be formed of a metal with high thermal conductivity such as aluminum, for example. The heat transfer belt 450 may be formed of a material such as polyimide, for example. The heat generated by the first heat source 442 in the second heating roller 440 may be transferred to the fixing nip between the heating unit 410 and the pressing unit 420 via the heat transfer belt 450, and may thus be used for heating an unfixed image.

As illustrated in FIGS. 3, 4, and 5, the fixing devices 200, 300, and 400, like the fixing device 100, may be equipped with a carbon nanotube heating layer, for example, having the structure illustrated in FIG. 2A, as a second heat source, and may thus reduce the consumption of power and improve the performance of fixing, as compared to a fixing device equipped with only one heat source.

Figure 6:
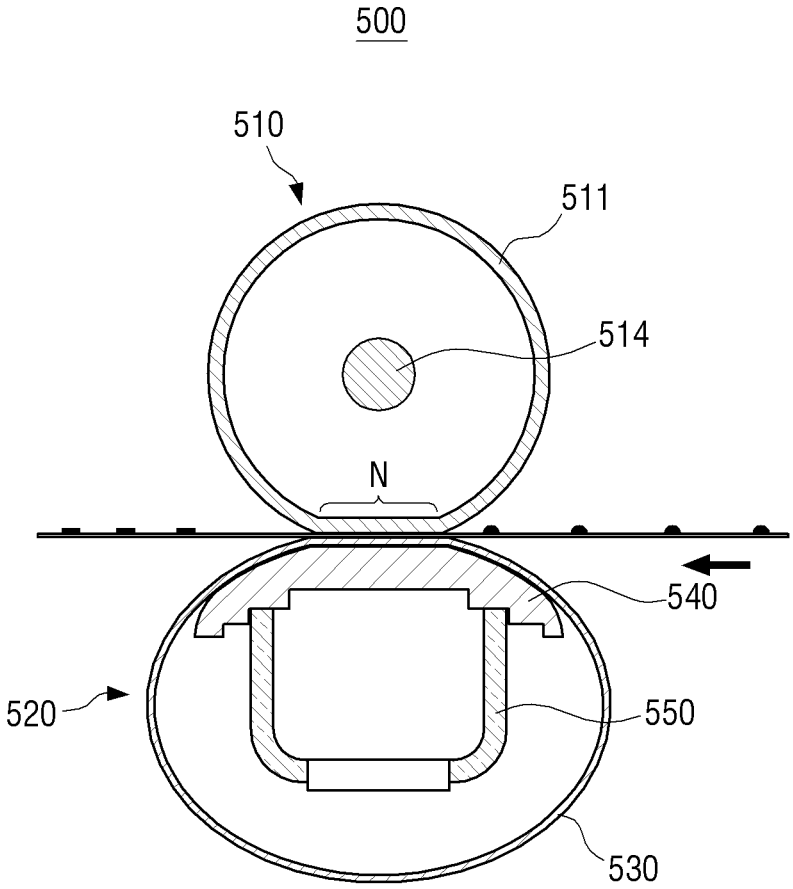
Figure 7A:
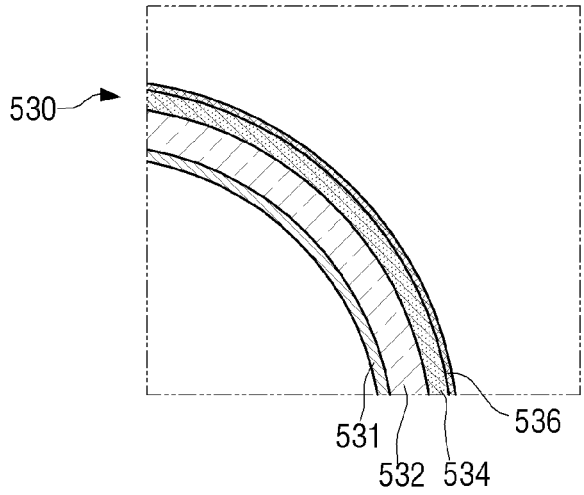
FIG. 7A is an enlarged cross-sectional view illustrating an example of a pressing unit illustrated in FIG. 6.

FIG. 6 is a cross-sectional view illustrating a fixing device according to an exemplary embodiment, and FIG. 7A is an enlarged cross-sectional view illustrating a pressing unit illustrated in FIG. 6.

Referring to FIGS. 6 and 7A, a fixing device 500 includes a heating unit 510 and a pressing unit 520.

The heating unit 510 and the pressing unit 520 may be disposed to face and contact each other, and may form a fixing nip N. While being passed through the fixing nip N, a print medium may be properly heated and pressed by the fixing device 100 so that an image may be fixed onto the print medium.

The heating unit 510 includes a pipe member 511 and a first heat source 514.

The pipe member 511 may be formed as a hollow pipe, and may contain the first heat source 514 therein. The pipe member 511 may include a base member (not illustrated) which is pipe-shaped, an elastic layer (not illustrated) which covers the base member, and an anti-adhesion layer (not illustrated) which covers the elastic layer. The base member may be formed of a metallic material with high thermal conductivity such as aluminum, for example.

The first heat source 514 may be disposed in the middle of the belt member 511. For example, the first heat source 514 may be implemented as a heating lamp or a resistive heating member. An unfixed image on the print medium may be heated via the pipe member 511 while passing the print medium through the fixing nip N.

The pressing unit 520 includes a belt member 530, a nip formation member 540, and a pressing frame 550.

The nip formation member 540 may be disposed between the pressing frame 550 and the belt member 530, and may transfer the pressing force of the pressing frame 550 to the belt member 530. The nip formation member 540 may be disposed to cover at least a part of the belt member 530, which forms the fixing nip N. The nip formation member 540 may have a flat part with a predetermined width. The fixing nip N may be formed flat in conformity with the flat part of the nip formation member 540. For example, the nip formation member 540 may be formed of a heat-resistant plastic material such as a liquid crystal polymer (LCP), etc.

The pressing frame 550 may be disposed in the belt member 530, and may be elastically supported against the heating unit 510 by an elastic member (not illustrated) such as a coil spring or a plate spring, for example. The fixing nip N may be formed by the pressing force provided by the elastic member.

The belt member 530 may be formed in the shape of a belt, and may be hollow in the middle. The belt member 530 may be disposed to be in contact with the heating unit 510, and may thus rotate along with the heating unit 510 during the rotation of the heating unit 510.

Referring to FIG. 7A, the belt member 530 includes a sleeve member 531 which is belt-shaped and hollow in the middle, an elastic layer 532 which surrounds the sleeve member 531, a carbon nanotube heating layer 534 which surrounds the elastic layer 532, and an anti-adhesion layer 536 which covers the carbon nanotube heating layer 534.

The sleeve member 531 may be formed of a rigid material. For example, the sleeve member 531 may be formed of polyimide, for example. The elastic layer 532 may be formed of an elastic material such as rubber, for example, and may thus be compressively deformed in the fixing nip N. The anti-adhesion layer 536 may be provided on the outermost side of the pressing unit 520 and may allow the print medium to be easily detached from the belt member 530.

The carbon nanotube heating layer 534 may be formed by mixing an elastic material and carbon nanotubes in a predetermined ratio. For example, LSR may be used as the elastic material, and the carbon nanotube heating layer 534 may be formed by mixing LSR and carbon nanotubes in a mass ratio of approximately 95:5 to approximately 85:15 so that the carbon nanotube heating layer 534 may have appropriate levels of elasticity and resistivity.

The fixing device 500, like the fixing device 100 illustrated in FIG. 1, may include the carbon nanotube heating layer 534 which serves as a second heat source for heating an unfixed image on the pressing unit 520. The carbon nanotube heating layer 534 may be disposed very close to the surface of the pressing unit 520. Therefore, the fixing device 500 may improve the performance of fixing (for example, a reduced FPOT) and reduce the consumption of power.

Figure 7B:
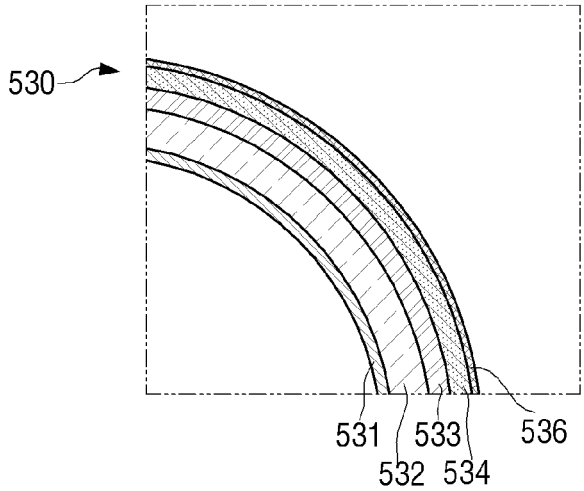
FIGS. 7B, 7C, and 7D are cross-sectional views illustrating examples of a belt member illustrated in FIG. 7A.
Figure 7C:
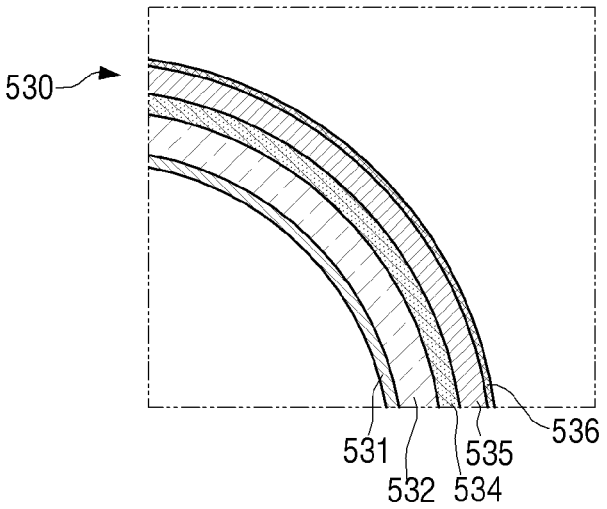
Figure 7D:
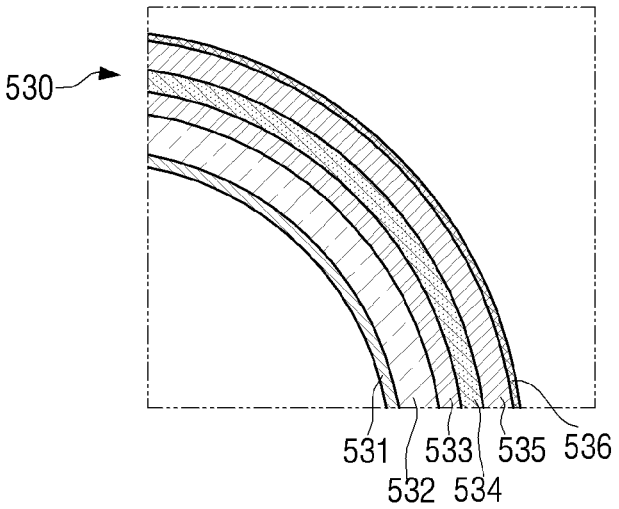

FIGS. 7B, 7C, and 7D are cross-sectional views illustrating variations of the belt member 530 illustrated in FIG. 7A, according to exemplary embodiments. Referring to FIG. 7B, the belt member 530 may also include an adiabatic layer 533 between the elastic layer 532 and the carbon nanotube heating layer 534. Alternatively, referring to FIG. 7C, the belt member 530 may also include an electrically insulating layer 535 between the carbon nanotube heating layer 534 and the anti-adhesion layer 536. Still alternatively, referring to FIG. 7D, the belt member 530 may include both the adiabatic layer 533 and the electrically insulating layer 535.

Figure 8:
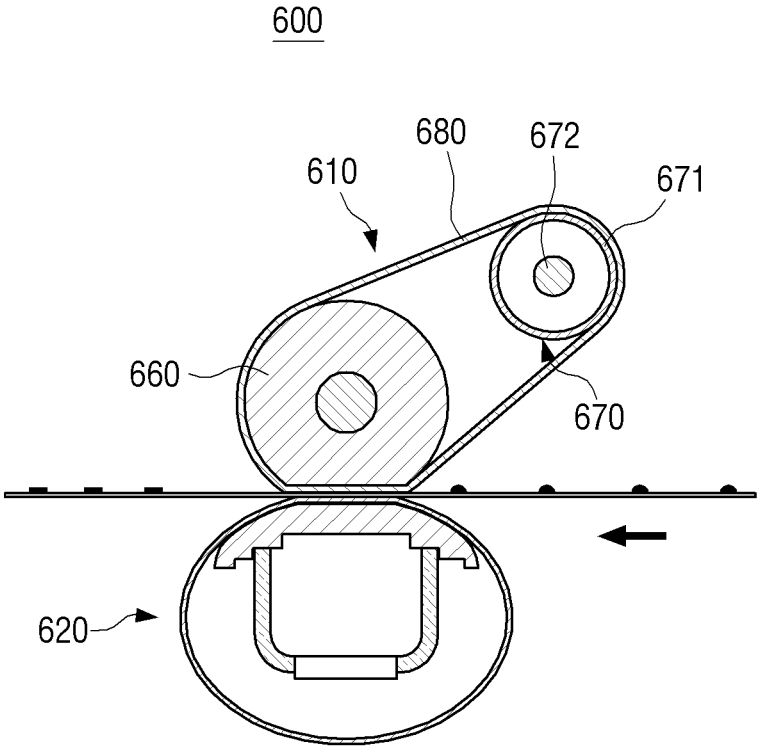
FIG. 8 is a cross-sectional view illustrating a fixing device according to an exemplary embodiment.

FIG. 8 is a cross-sectional view illustrating a fixing device according to an exemplary embodiment.

Referring to FIG. 8, a fixing device 600 includes a heating unit 610 and a pressing unit 620.

The heating unit 610 includes a first heating roller 660, a second heating roller 670, and a heat transfer belt 680. The first heating roller 660, the second heating roller 670, and the heat transfer belt 680 may be the same as their respective counterparts illustrated in FIG. 5. The second heating roller 670 includes a pipe member 671 which is formed of a metallic material (for example, aluminum) and a first heat source 672 which is contained in the pipe member 671. When a print medium is being passed through a fixing nip, the heat generated by the first heat source 672 may be transferred to the print medium via the heat transfer belt 680, and may thus be used to fix an image onto the print medium.

The pressing unit 620 may be the same as its counterpart illustrated in FIG. 5, i.e., the pressing unit 520. The pressing unit 620, like the pressing unit 520, includes a carbon nanotube heating layer. Accordingly, it is possible to reduce the consumption of power and improve the performance of fixing, as compared to a fixing device equipped with only one heat source.

Figure 9:
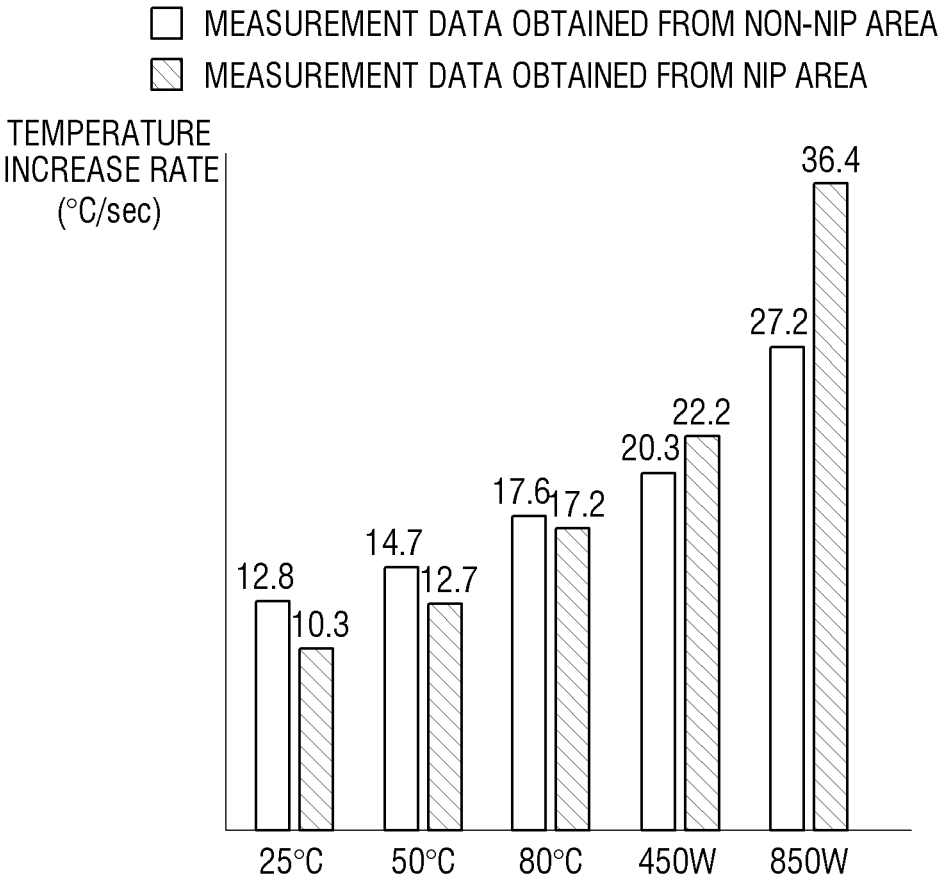
FIG. 9 is a graph showing temperature increase rate data obtained from a related-art fixing device and a fixing device according to an exemplary embodiment.

A fixing device according to an exemplary embodiment, which is equipped with first and second heat sources, and a related-art fixing device which is equipped with the first heat source only were tested for the performance of increasing temperature. During the test, a fixing device (hereinafter referred to as the fixing device according to the present description) having the structure illustrated in FIG. 1 and a fixing device (hereinafter referred to as the related-art fixing device) having the same structure as the fixing device 100 illustrated in FIG. 1 except for not having the carbon nanotube heating layer 124 were used, and the surface temperature of a heating unit of each of the fixing device according to the present description and the related-art fixing device was measured over time from both a nip area and a non-nip area in each of the fixing device according to the present description and the related-art fixing device. The results of the test are shown in FIG. 9 and Table 1 below.

TABLE 1

| Classification | | Temperature Measurements from Non-Nip Area | | | Temperature Measurements from Nip Area | | |
|---|---|---|---|---|---|---|---|
| | | Target Temp. (° C.) | Time Taken to Reach Target Temp. (sec) | Temp. Increase Rate (° C./sec) | Target Temp. (° C.) | Time Taken to Reach Target Temp. (sec) | Temp. Increase Rate (° C./sec) |
| Initial Temp. | 25° C. | 140.0 | 10.9 | 12.8 | 120.0 | 11.7 | 10.3 |
| of Pressing | 50° C. | 140.0 | 9.5 | 14.7 | 120.1 | 9.4 | 12.7 |
| Unit (Related Art) | 80° C. | 140.1 | 8.0 | 17.6 | 120.0 | 7.0 | 17.2 |
| Power Consumed | 450 W | 140.1 | 6.9 | 20.3 | 120.0 | 5.4 | 22.2 |
| by Pressing Unit | 850 W | 140.2 | 5.2 | 27.2 | 120.1 | 3.3 | 36.4 |
| (Present Description) | | | | | | | |

Referring to Table 1, measurement data obtained from the related-art fixing device is as shown in three rows in the middle, and measurement data obtained from the fixing device according to the present description is as shown in two rows at the bottom.

In the case of the related-art fixing device, when the initial temperature of the pressing unit of the related-art fixing device is 25° C., the related-art fixing device has a temperature increase rate of 12.8° C./sec in the non-nip area and a temperature increase rate of 10.3° C./sec in the nip area. On the other hand, in the case of the fixing device according to the present description, when the power consumption of the carbon nanotube heating layer of the fixing device according to the present description is 450 W, the fixing device according to the present description has a temperature increase rate of 20.3° C./sec in the non-nip area and a temperature increase rate of 22.2° C./sec in the nip area.

As shown in Table 1, the fixing device according to the present description has a higher temperature increase rate in both the nip area and the non-nip area than the related-art fixing device.

Referring to Table 1 and FIG. 9, the related-art fixing device has a higher temperature increase rate in the non-nip area than in the nip area, whereas the fixing device according to the present description has a higher temperature increase rate in the nip area than in the non-nip area. Accordingly, the fixing device according to the present description may be more efficient than the related-art fixing device in terms of heating a fixing nip.

The amount of power consumed by each of the fixing device according to the present description and the related-art fixing device to reach a target temperature was calculated based on the measurement data shown in Table 1, and the results of the calculation are as shown in Table 2 below.

TABLE 2

| Classification | | Amount of Energy Consumed for Heating (J) | |
|---|---|---|---|
| | | Measurement Data Obtained from Non-Nip Area | Measurement Data Obtained from Nip Area |
| Related-Art Fixing Device | | 9300.3 | 9903.8 |
| Fixing Device According to Present Description | Power Consumption of Pressing Unit: 450 W | 8985.0 | 7035.0 |
| | Power Consumption of Pressing Unit: 850 W | 8757.6 | 5612.6 |

Referring to Table 2, the fixing device according to the present description consumes much less electric energy than the related-art fixing device to reach the same target temperature. That is, the power consumption of the fixing device according to the present description may be less than the power consumption of the related-art fixing device.

Figure 10:
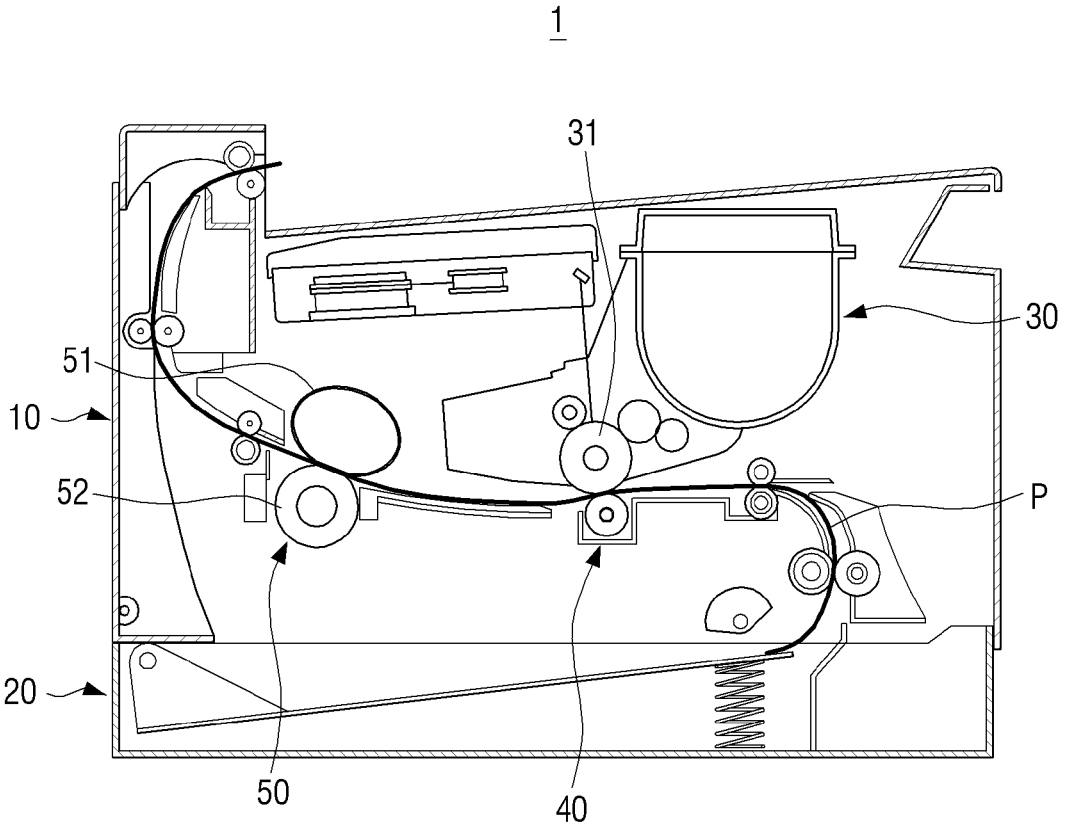
FIG. 10 is a cross-sectional view illustrating an image forming apparatus according to an exemplary embodiment.

FIG. 10 is a cross-sectional view illustrating an image forming apparatus according to an exemplary embodiment.

Referring to FIG. 10, an image forming apparatus 1 includes a main body 10 and a print medium supply unit 20. Various elements such as a developer unit 30 including an image carrier 31, a transfer unit 40, a fixing device 50, and the like are installed in the main body 10.

A print medium may be picked up from the print medium supply unit 20, may be injected into the main body 10, and may be transferred along a path P. An image may be transferred onto the print medium while the print medium is being passed through a transfer nip between the image carrier 31 and the transfer unit 40. The transferred image may be fixed while the print medium is being passed through a fixing nip between a heating unit 51 and a pressing unit 52 of the fixing device 50. Then, the print medium may be ejected from the main body 10.

The fixing device 50 may have the same structure as one of the fixing devices 100, 200, 300, 400, 500, and 600 illustrated in FIGS. 1, 3, 4, 5, 6, and 8, respectively. The heating unit 51 of the fixing device 50 may include a first heat source for fixing an image onto a print medium, and the pressing unit 52 of the fixing device 50 may include a carbon nanotube heating layer, for example, having the same structure as the carbon nanotube heating layer 124 or 534 illustrated in FIG. 2A or 7A.

The image forming apparatus 1 may improve the performance of fixing (for example, a reduced FPOT) and reduce the consumption of power, as compared to a related-art image forming apparatus.

The foregoing exemplary embodiments and advantages are merely exemplary and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A fixing device which is included in an electrophotographic image forming apparatus, the fixing device comprising:

a heating unit which comprises a first heat source to heat an unfixed image on a print medium; and a pressing unit which forms a fixing nip by contacting the heating unit, wherein the pressing unit comprises:

a carbon nanotube heating layer as a second heat source to heat the unfixed image, a shaft member which is cylindrical, an elastic layer which surrounds the shaft member, the carbon nanotube heating layer which surrounds the elastic layer, and an anti-adhesion layer which surrounds the carbon nanotube heating layer, and wherein the heating unit comprises:

a belt member which accommodates the first heat source therein and is placed in contact with the pressing unit, a pressing frame which is disposed in the belt member and presses the belt member against the pressing unit, and a nip formation member which is disposed between the pressing frame and the belt member, and transfers a pressing force of the pressing frame to the belt member.

2. The fixing device of claim 1, wherein the carbon nanotube heating layer is formed by mixing an elastic material and carbon nanotubes.

3. The fixing device of claim 2, wherein the elastic material is liquid silicon rubber (LSR).

4. The fixing device of claim 3, wherein the carbon nanotube heating layer is formed by mixing LSR and the carbon nanotubes in a mass ratio of 95:5 to 85:15.

5. The fixing device of claim 1, wherein the pressing unit further comprises:

an adiabatic layer which is disposed between the elastic layer and the carbon nanotube heating layer; and an electrically insulating layer which is disposed between the carbon nanotube heating layer and the anti-adhesion layer.

6. The fixing device of claim 1, wherein the first heat source is at least one of a heating lamp, a resistive heating material, and a ceramic heater.

7. An electrophotographic image forming apparatus including a fixing device to fix an unfixed image, the fixing device comprising:

a heating unit which comprises a first heat source to heat an unfixed image on a print medium; and a pressing unit which forms a fixing nip by contacting the heating unit, wherein the pressing unit comprises:

a carbon nanotube heating layer as a second heat source to heat the unfixed image, a shaft member which is cylindrical;

an elastic layer which surrounds the shaft member;

the carbon nanotube heating layer which surrounds the elastic layer; and an anti-adhesion layer which surrounds the carbon nanotube heating layer, and wherein the heating unit comprises:

a belt member which accommodates the first heat source therein and is placed in contact with the pressing unit, a pressing frame which is disposed in the belt member and presses the belt member against the pressing unit, and a nip formation member which is disposed between the pressing frame and the belt member, and transfers a pressing force of the pressing frame to the belt member.

8. An image fixing apparatus to fix an image onto a print medium, the apparatus comprising:

a heater comprising a first heat source; and a press comprising a second heat source, wherein the heater and the press form a fixing nip, the second heat source comprises a heating layer, and the heating layer comprises carbon nanotubes, wherein the heater comprises:

a belt member which accommodates the first heat source therein and is placed in contact with the press, a pressing frame which is disposed in the belt member and presses the belt member against the press, and a nip formation member which is disposed between the pressing frame and the belt member, and transfers a pressing force of the pressing frame to the belt member, and wherein the press comprises:

a shaft member which is cylindrical;

an elastic layer which surrounds the shaft member;

the carbon nanotube heating layer which surrounds the elastic layer; and an anti-adhesion layer which surrounds the carbon nanotube heating layer.

9. The image fixing apparatus of claim 8, wherein the press further comprises at least one of a thermally insulating layer disposed in the press interior to the heating layer; and an electrically insulating layer disposed in the press exterior to the heating layer.

* * * * *